US006955461B2

(12) United States Patent
Kar et al.

(10) Patent No.: US 6,955,461 B2
(45) Date of Patent: Oct. 18, 2005

(54) TICKLER FOR SLURRY REACTORS AND TANKS

(75) Inventors: Kishore K. Kar, Midland, MI (US); Richard F. Cope, Midland, MI (US); Steve Sandor, Midland, MI (US); Angela Pennington, Midland, MI (US)

(73) Assignee: Dow Global Technologies, Inc., Midland, MI (US)

( * ) Notice: Subject to any disclaimer, the term of this patent is extended or adjusted under 35 U.S.C. 154(b) by 128 days.

(21) Appl. No.: 10/350,786

(22) Filed: Jan. 24, 2003

(65) Prior Publication Data

US 2004/0145966 A1 Jul. 29, 2004

(51) Int. Cl.[7] ..... B01F 7/20

(52) U.S. Cl. ..... 366/196; 366/329.2; 366/330.3; 366/330.7; 416/201 R; 416/243

(58) Field of Search ..... 366/196, 329.1, 366/329.2, 330.1, 330.3, 330.7; 422/225–229; 416/198 A, 201 A, 243, 210 R

(56) References Cited

U.S. PATENT DOCUMENTS

| | | | | | |
|---|---|---|---|---|---|
| 250,864 | A | * | 12/1881 | Winslow | 126/284 |
| 449,862 | A | * | 4/1891 | Pool | 416/243 |
| 668,211 | A | | 2/1901 | Powter | |
| 755,426 | A | * | 3/1904 | Wood | 416/243 |
| 1,359,693 | A | * | 11/1920 | Gill | 416/200 R |
| 1,850,199 | A | * | 3/1932 | Bryant | 366/330.7 |
| 2,151,146 | A | | 3/1939 | Petry | |
| 2,231,827 | A | * | 2/1941 | Greene | 416/201 R |
| 2,758,945 | A | | 8/1956 | Widmayer | |
| 2,794,628 | A | | 6/1957 | Fessenden | |
| 2,896,925 | A | * | 7/1959 | Place | 416/201 R |
| 2,965,180 | A | * | 12/1960 | Killam | 416/134 R |
| 3,024,010 | A | | 3/1962 | Sperling | |
| 3,470,265 | A | | 9/1969 | Sprow | |
| 4,193,702 | A | | 3/1980 | Davis | |
| 4,264,215 | A | | 4/1981 | Nunlist et al. | |
| 4,468,130 | A | * | 8/1984 | Weetman | 366/330.2 |
| 4,650,343 | A | | 3/1987 | Doom et al. | |
| 4,729,878 | A | | 3/1988 | Pommier et al. | |
| 4,891,966 | A | | 1/1990 | Kramer | |
| 5,090,815 | A | * | 2/1992 | Bohle | 366/192 |
| 5,112,192 | A | * | 5/1992 | Weetman | 416/201 A |
| 5,158,434 | A | * | 10/1992 | Weetman | 416/201 A |
| RE34,386 | E | * | 9/1993 | Davidson et al. | 416/242 |
| 6,247,897 | B1 | * | 6/2001 | Patel | 416/197 R |
| 6,688,849 | B2 | * | 2/2004 | Keeton | 416/197 R |

OTHER PUBLICATIONS

Article, "Solids Suspension with Mixed Impeller Systems," Myers et al., *AIChE*, 1999 annual meeting.

* cited by examiner

*Primary Examiner*—David Sorkin

(57) ABSTRACT

The present invention is directed to a tickler impeller and agitation system for use in stirred slurry reactors and storage tanks. The tickler impeller when mounted on a shaft is effective for providing an inward and downward swirl in a slurry medium which directs solids suspended in the slurry towards the bottom of the tank and towards the shaft on which the impeller is mounted. Directing solids suspended in a slurry downwards and towards the center of the tank rather than pushing those solids away from the center reduces solid deposits on the side of the tank, facilitates draining of the tank, and reduces nozzle starving and pump starvation.

46 Claims, 4 Drawing Sheets

TICKLER FOR SLURRY REACTORS AND TANKS

The present invention relates to a tickler impeller and agitation system for use in slurry reactors and storage tanks. More specifically, the tickler impeller includes blades that are curved, angled upward and pitched in a manner effective for providing an inward and downward swirl in a slurry medium in the tank, which directs solids suspended in the slurry towards the bottom and center of the tank during slurry drainage.

BACKGROUND

Agitation systems in stirred slurry reactors and storage tanks often include a tickler (kicker) impeller as part of the agitation system. The tickler impeller is mounted on an agitator shaft and located at close proximity to the tank bottom. The purpose of the tickler is to keep the solids suspended and eliminate settling of the solids at the bottom of the tank. Ticklers are normally pitch blade turbines (PBTs) or flat blade turbines (FBTs), see FIGS. 1 and 2, respectively.

In relation to a main impeller, which agitates solids in a liquid medium, the tickler is a smaller agitator located in a spaced relation below the main impeller. While draining the tank, particularly after the slurry level has receded below a main impeller, efficiency of the tickler for solids suspension is critical to avoid solids deposition, pump starvation, and choking of the flow due to plugging of the pump suction line. Typically, PBT and FBT ticklers function near the bottom of the tank as radial impellers which tend to throw the slurry out towards the wall of the tank, i.e. away from the central nozzle or drain. As a result, solids can stick to the wall and necessitate the extra work of removal by pressure spraying them from the wall. Pump starvation and long discharge times also can result from discharge nozzle starvation near the end of draining the slurry from the tank.

SUMMARY

The present invention is directed to a tickler impeller and agitation system for use in stirred slurry reactors and storage tanks. The present invention also includes a method for draining a tank using the tickler impeller of the invention. The tickler impeller when mounted on a vertical shaft is effective for providing an inward and downward swirl in a slurry medium which directs solids suspended in the slurry towards the bottom of the tank and towards the shaft on which the impeller is mounted. Directing solids suspended in a slurry downwards and towards the center of the tank rather than pushing those solids away from the center reduces solid deposits on the bottom and side of the tank, facilitates draining of the tank, and reduces nozzle plugging and pump starvation.

The angle of the blade from the horizontal, blade curvature and the angle of the face of the blade or blade pitch of the tickler impeller of the present invention are effective for directing solids suspended in a slurry downwards and towards the center of the tank which improves impeller drainage efficiency. The blade pitch is also beneficial in reducing impeller drag and power number. The tickler impeller of the present invention improves impeller drainage efficiency (1) by reducing the amount of material left as a heel in the bottom of an emptied tank and (2) by providing a faster drain time. The tickler impeller of the invention is effective for decreasing drain time and heel mass compared to a downward pumping PBT impeller of the same size rotating at the same specific power level in the same suspension. The geometry and shape of the tickler impeller of the invention is such that if the tickler impeller was standardized in size and environment so that it had an 11 inch diameter and was used in a 30 inch diameter tank having a cone-shaped bottom at a 75° angle from the vertical centerline, the tickler impeller would be effective for reducing the amount of suspension left in the tank at least by about 10%, and generally by about 15 to about 90% compared to a downward pumping 11" diameter PBT tickler impeller in the same system; and would be effective for decreasing drain time by at least about 10%, and generally by about 30 to about 45% compared to a downward pumping 11" diameter PBT tickler impeller in the same system.

The blades of the tickler impeller are mounted on a hub for axial rotation on a shaft, which shaft is generally perpendicular to the horizontal, for mixing the contents of the tank or container. The tickler impeller of the present invention includes at least two and up to twelve curved blades which are rounded at their ends or tips opposite to the hub. Preferably, the tickler impeller has three to four blades. The rounded blade tips are effective for lessening tip shear. In another aspect, the edges of the blades may be rounded. A rounded upper edge of the blade which extends from the hub and shaft to the rounded end or tip and is effective for diminishing tickler impeller interference in a flow pattern of the main impeller which distributes solids throughout the tank. A rounded lower edge of the blade opposite the upper edge extends from the hub and shaft to the rounded end or tip and is effective for reducing the amount of radial character that the impeller gives the slurry as its level recedes below the blade tip. More inward and downward flow is imparted to the slurry liquid as the level of the suspension in the tank recedes. Further, blades which have rounded edges may be glass coated for some mixing/reaction applications.

In one aspect, the curved blades of the tickler impeller are mounted to a vertical shaft, preferably at equal distances from one another. This provides balance to the blade and uniformity in the imparted hydraulic force. The blades extend over the bottom of the tank and are at an angle from the horizontal that is equal to or greater than an angle of the tank bottom. Generally, the blades are upwardly angled to match the shape or angle of the bottom (typically conical in storage tanks) such that a line tangent to the lower edge of each blade is parallel to the tank bottom. The blades extend upward from the horizontal at an angle of from about 0° to less than a vertical 90°, preferably from 0° to 75° from horizontal, and preferably are angled upwardly 15° in a 15° coned-bottom tank. Angled blades are especially important in tanks having conical or cone shaped bottoms as angling of blades is effective to allow placement of the blades as close as possible to the tank bottom. In this aspect, the blades may be from about ½ to about 4 inches from the bottom of the tank (depending on the sizes of the particles and the tank).

The blades of the tickler impeller of the present invention are curved to create a cupped surface in the liquid being stirred that opens in the direction of the rotation of the blades. Rotating in this direction means that the tickler impeller is rotated such that the concave side of the blade leads and the convex side trails. Each of the curved blades has a radius of the curved surface of from 0.1 to 10× the diameter of the tickler impeller. It also should be recognized that it is preferable that the blades have a smooth curvature, but that the curve of the blades could be obtained in increments or facets. In operation, the rotating blades of the tickler impeller direct solids suspended in a slurry downwards and towards the center of the tank.

The curved faces of the blades of the tickler impeller have an average pitch or angle from the vertical of from 75° or less, in an important aspect an average pitch of 30° to 60°, and in a very important aspect an average pitch of 45°. The pitch over the length of the blade may vary from about 10° to about 90°, preferably about 45°. In another aspect, the ratio of blade height to the impeller diameter is about 0.05 to about 0.75 and in an important aspect is about 0.2.

BRIEF DESCRIPTION OF THE FIGURES

FIG. 5*b* shows a perspective view of the blade of FIG. 5*a*.

DETAILED DESCRIPTION

As used herein curved blade and blade curvature mean that the blade as viewed from the top has a generally crescent shape with the concave side of the crescent facing the direction of intended rotation of the blade and the convex side of the blade trailing the concave side of the blade when the blade is rotated. The radius of the curved surface of the blades is labeled in FIG. 3 as 2.

As used herein, the angle of the blades from the horizontal means the angle at which the tangent line of the bottom edge of the blade is from the horizontal such that the rotating blades do not interfere with or contact the bottom of a container or tank which may be horizontal angled or curved to form a cone-like or curved bottom. This angle is illustrated in FIG. 4 as 102.

Figure 5B:
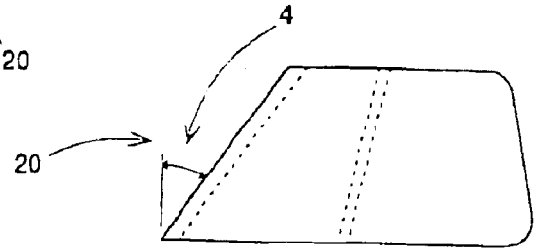
FIGS. 5*a–b* show a side view of a blade of the tickler impeller of the present invention and the pitch of the blade.
Figure 5A:
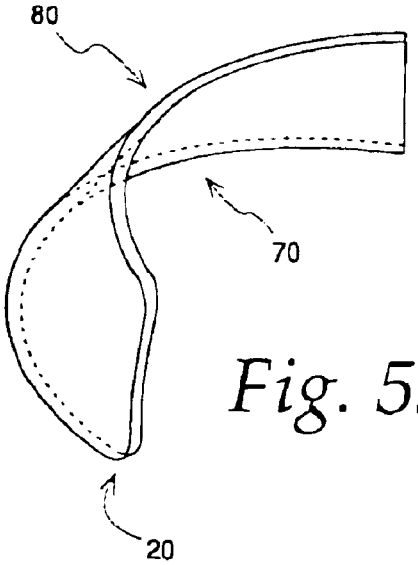

As used herein, the pitch of the blade means the angle of the face of the blade from a vertical axis as seen as 4 in FIG. 5*b*.

Figure 1:
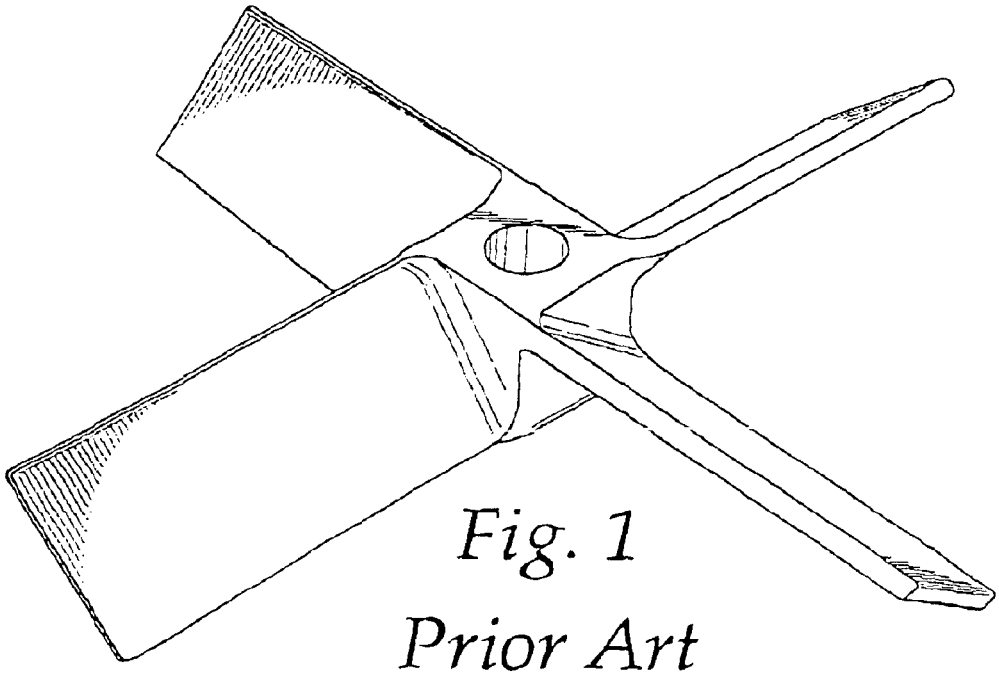
Fig. 1 Prior Art
FIG. 1 shows a prior art pitched blade turbine impeller.
Figure 2:
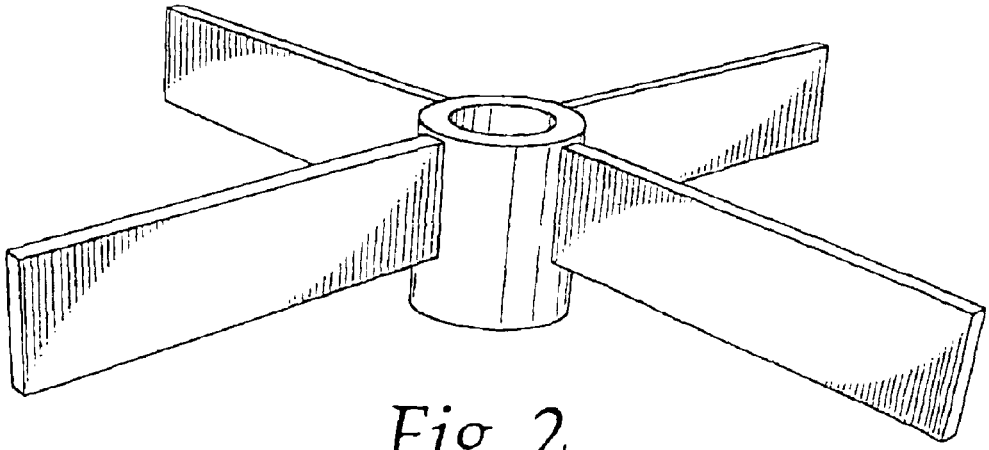
Fig. 2 Prior Art
FIG. 2 shows a prior art flat blade turbine impeller.
Figure 3:
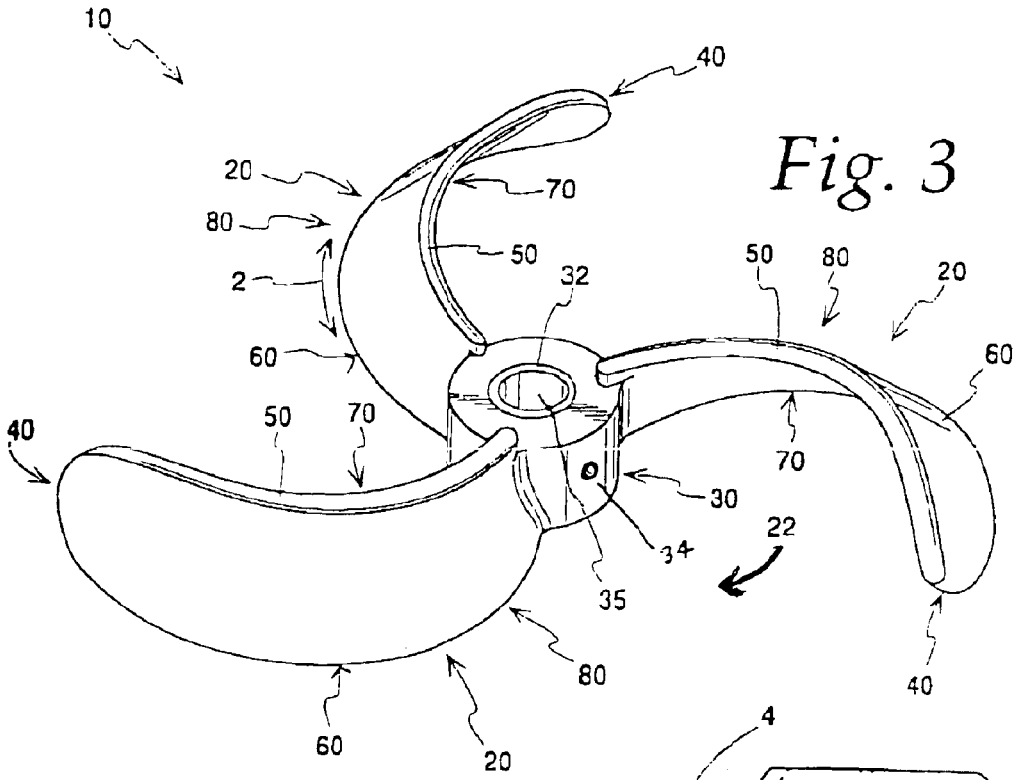
FIG. 3 shows one aspect of the tickler impeller of the present invention.

The tickler impeller 10 of the present invention is shown in FIG. 3. The tickler impeller 10 may include three curved blades 20 which are mounted on a hub 30. In the illustrated embodiment, the hub 30 includes a shaft collar 32, set screw 34 and shaft opening 35 which allow the tickler impeller 10 to be mounted and attached to a shaft (such as a shaft 120 shown in FIG. 4).

Figure 4:
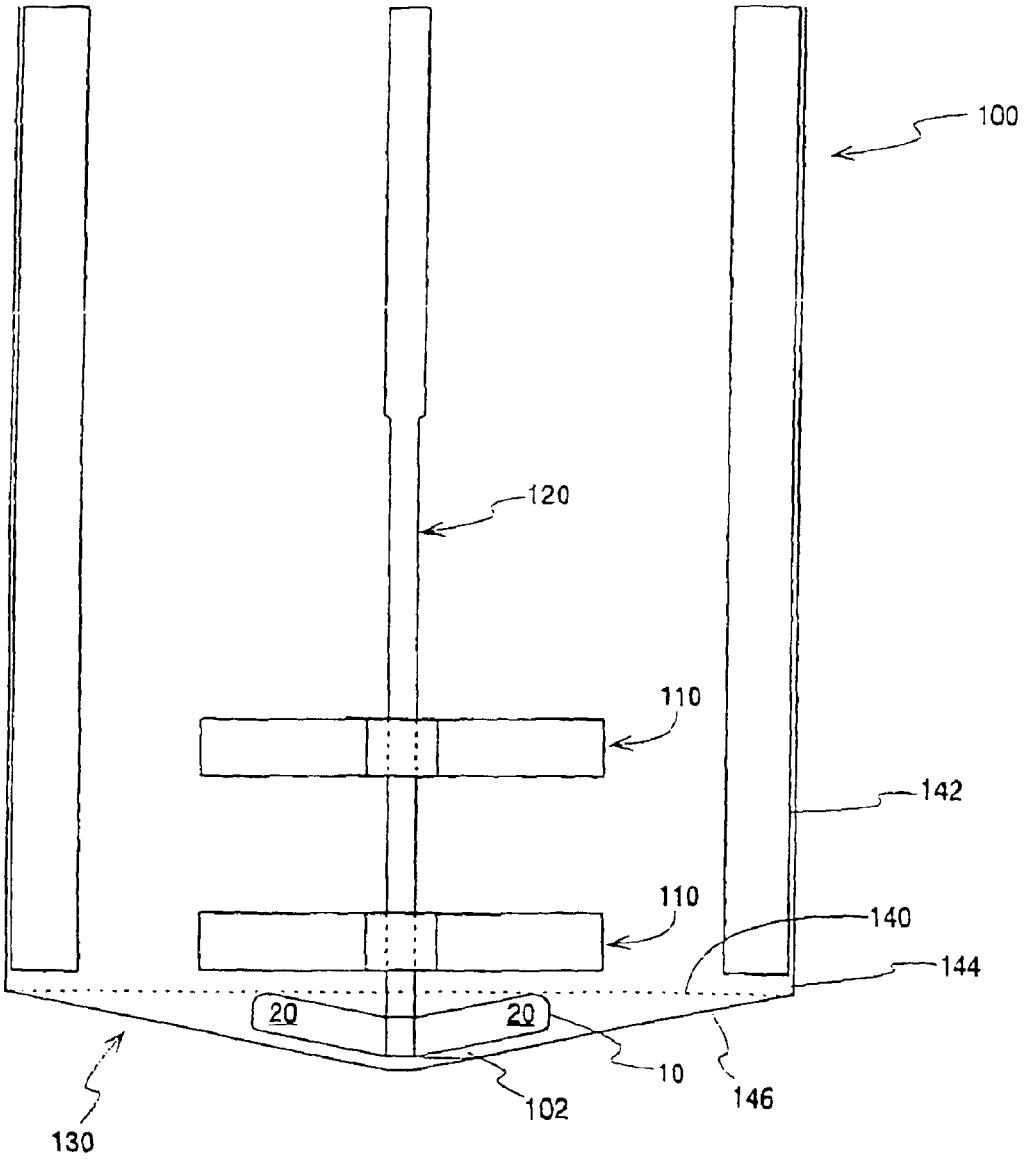
FIG. 4 illustrates a schematic of a tank that includes 2 PBTs and one tickler impeller.
Figure 6B:
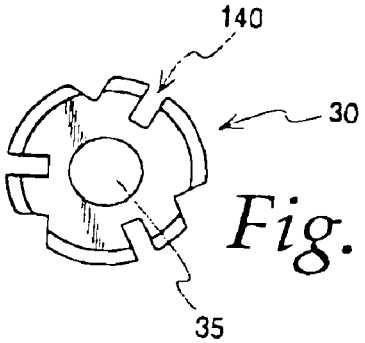
FIGS. 6*a* and 6*b* show one aspect of the hub of the tickler impeller of the present invention.
Figure 6A:
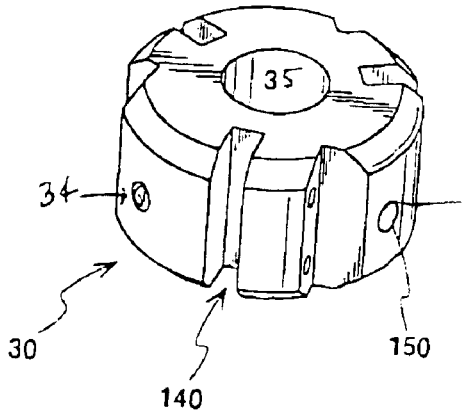

As shown in FIGS. 6*a–b*, the hub 30 includes a shaft opening 35 that allows the tickler impeller 10 to be positioned on a shaft, such as for example shaft 120 shown in FIG. 4. The shaft opening 35 may be fitted with a removable shaft collar 32 (shown in FIG. 3).

As seen in FIGS. 6*a–b*, the hub 30 includes blade receiving indentations 140 which are spaced are equal distances around the hub 30 and which are effective for receiving the curved blades 20. The hub 30 is secured to a shaft with at least one set screw 34 which is positioned in a set screw opening 150 as seen in FIG. 6*a*. As those skilled in the art will recognize, however, the blades may be mounted on the hub, and the hub may be mounted on the shaft by set screws, keys, shear pins or may be integrated onto the hub such as a welded, molded or cast part.

The curved blades 20 of the tickler impeller 10 rotate in the direction of the curvature such that a concave side 70 of the curved blade 20 leads and a convex side 80 trails as shown by arrow 22 in FIG. 3. The curved blades 20 may include rounded ends or tips 40 and an upper edge 50 and a lower edge 60 which are rounded.

A tickler impeller 10 in a reactor tank 100 is illustrated in FIG. 4. In this aspect of the invention, the tickler impeller 10 is located below a main impeller 110 and is mounted on the same shaft 120 as a second impeller 110. As illustrated in FIG. 4, the reactor tank 100 has a conical shaped bottom 130 and the curved blades 20 of the tickler impeller 10 are parallel to the conical shaped bottom 130. The above impeller is located generally on the tangent line 140, which is the line perpendicular from the vertical sides 142, of the tank at a point where the vertical side joins the angled base 146, of the conical bottom 130 of the tank. The tickler impeller generally is located below the tangent line.

The blade can be made of any material that is compatible with the contents of the tank, such as non-reactive plastic or stainless steel.

The following examples illustrate methods for carrying out the invention and should be understood to be illustrative of, but not limiting upon, the scope of the invention which is defined in the appended claims.

EXAMPLES

Example I

Slurry Mixing

Three different types of tickler impellers were installed below dual 15" OD 4-blade PBTs in a 30" OD Plexiglass mixing tank. The three tickler impellers were as follows.

1. Up-pumping 11" OD PBT with 4 chevron-shaped blades (45° pitch, with 15° angle above horizontal).

2. Down-pumping 11" OD PBT with 4 chevron shaped blades (45° pitch, with 15° angle above horizontal).

3. Down-pumping 11" OD tickler impeller with crescent-shaped blades (generally 45° pitch, with 15° angle above horizontal). This tickler impeller represent one aspect of the tickler impeller of the present invention.

In tests conducted with each of these ticklers, the tank was filled to a depth of approximately 16" above the tangent line with a 40 weight percent slurry of Saran® beads in water. The impeller rotation rate was set so that the 15" PBTs, in combination with each tickler type, required the same amount of motor torque (26.1 in-lb). When all of the slurry beads had been fully suspended for at least 20 minutes, the tank was drained. The draining procedure was recorded on a digital video camera, while total draining time and pounds of resin heel left in the tank bottom were measured. Test results were as follows.

Saran® Resin A (Available from The Dow Chemical Company)

The Sauter mean particle diameter is 350$\mu$ and the suspension density is 1.4 g/cc.

| Tickler No. | Drain Time (min) | Tank Heel (grams) |
|---|---|---|
| 1 | 8.5 | 91 |
| 2 | 7.75 | 727 |
| 3 | 5.0 | 45 |

Saran® Resin B (Available from The Dow Chemical Company)

The Sauter mean particle diameter is 350$\mu$ and the suspension density is 1.4 g/cc, but is different from Resin A in that the particles are surface coated to cause agglomeration.

| Tickler No. | Drain Time (min) | Tank Heel (grams) |
|---|---|---|
| 1 | 8.75 | 527 |
| 2 | 8.5 | 636 |
| 3 | 6.5 | 436 |

Numerous modifications and variations in practice of the invention are expected to occur to those skilled in the art upon consideration of the foregoing detailed description of the invention. Consequently, such modifications and variations are intended to be included within the scope of the following claims.

What is claimed is:

1. An apparatus comprising:

a container, the container having a bottom and a bottom drain;

a tickler impeller in the container above the bottom of the container, the tickler impeller having at least two curved blades mounted on a vertical shaft for rotation in a container, the curved blades extending upwardly at an angle from the horizontal of from 15° to less than 90°, each of the blades having a concave face which faces downwardly towards the bottom of the container and a convex face opposite the concave face which convex face faces upwardly, the concave face leading and convex face trailing when the tickler impeller is rotated in the direction of rotation of the tickler impeller, the concave face curvingly facing downward from the end toward the shaft to the end of the blade opposite the shaft, the angle from the horizontal and the downward angle of the face being effective for creating an inward swirl towards the a bottom of the container when the tickler impeller is rotated in the direction such that the concave face leads and the convex face trails.

2. The apparatus of claim 1, wherein the tickler impeller has two to twelve blades and the angle from the horizontal, the downward angle of the face and the curvature of the tickler impeller are effective for decreasing drain time of the container as compared to a downward pumping pitch blade turbine having the same number of blades, blades of the same size and blades of the same pitch.

3. An apparatus comprising;

a container, the container having a conically-shaped bottom and a bottom drain;

a tickler impeller above the bottom of the container, the tickler impeller having at least three curved blades mounted on a vertical shaft for rotation in the container, the curved blades extending upwardly at an angle from the horizontal of from 15° to less than 90°, the curved blades having lowest edges and a line tangent to such lowest edges extending at an angle which when placed in a container is at least parallel to the conically-shaped bottom of the container, each of the blades having a concave face which faces curvingly downwardly at a pitch angle, the concave face leading when the tickler impeller is rotated, the angle from the horizontal, the pitch angle of the face and the curvature of the blades being effective for creating an inward swirl towards a bottom of the container when the tickler impeller is rotated an the direction with the concave face leading to reduce drain time of the container as compared to a downward pumping pitch blade turbine having the same number of blades, blades of the same size and blades of the same pitch.

4. The apparatus of claim 3 wherein the shaft includes a hub, the curved blades having tips opposite the hub which are rounded, the blades extending at an angle from the horizontal of from 15° to 75°, the blades having an average pitch of about 30° to about 60°.

5. The apparatus of claim 4, wherein the curved blades have an average pitch of about 45°.

6. The apparatus of claim 4, wherein the tickler impeller has three to twelve curved blades and the curved blades are spaced an equal distance apart from each other.

7. The apparatus of claim 4, wherein the curved blades have lowest edges and a line tangent to such lowest edges extending at an angle which is at least parallel to the bottom, of the tank.

8. The apparatus of claim 4, wherein the blades extend upward at an angle of about 15° from horizontal.

9. The apparatus of claim 4, wherein the blades have rounded edges.

10. The apparatus of claim 4, wherein the blade height to impeller diameter has a ratio of from 0.05 to 0.75.

11. A mixing impeller system comprising:

at least one impeller;

at least one tickler impeller; and a vertical shaft, the at least one impeller and one tickler impeller mounted on the vertical shaft, the tickler impeller mounted below the at least one impeller, the tickler impeller comprising at least two curved tickler impeller blades mounted on the shaft for rotation in a container having a bottom, the curved tickler impeller blades having lowest edges and a line tangent to such lowest edges extending at an angle from the horizontal which is at least parallel to the bottom of the container when placed in the container, the blades of the impeller having a length which is longer than the length of the blades of the tickler impeller, the blades of the tickler impeller having a concave face which faces downwardly at least one angle from the vertical towards the bottom of the container when placed in the container and a convex face which faces upwardly, the concave face of the blade of the tickler impeller leading and the convex face trailing when the tickler impeller is rotated in the direction of intended rotation of the tickler impellers the concave face curvingly facing downward from the end toward the shaft to the end of the blade opposite the shaft, the angle from the horizontal, the pitch angle of the concave face from the vertical effective for creating an inward swirl towards a bottom of the container when the tickler impeller is rotated in a direction such that the concave face leads and the convex trails to reduce the drain time of the container as compared to a downward pumping pitch blade turbine having the same number of blades, blades of the same size and blades of the same pitch.

12. The mixing impeller system of claim 11, wherein the curved blades of the tickler impeller have tips opposite the shaft which are rounded, the blades extending at an angle from the horizontal of from 0° to 75°, the concave face of the tickler blades having an average pitch of about 30° to about 60°.

13. The mixing impeller system of claim 11, wherein the curved blades have an average pitch of about 45°.

14. The mixing impeller system of claim 11, wherein the tickler impeller has two to twelve curved blades and the curved blades are spaced an equal distance apart from each other.

15. The mixing impeller system of claim 11, wherein the blades extend upward from the horizontal at an angle of about 15° from horizontal.

16. The mixing impeller system of claim 11, wherein the blades have rounded edges.

17. The mixing impeller system of claim 11, wherein the blade height to length has a ratio of from 0.05 to 0.75°.

18. A mixing impeller system comprising:

at least one impeller;

at least one tickler impeller;

a vertical shalt, the at least one impeller and one tickler impeller mounted on the vertical shaft, the tickler impeller mounted below the at least one impeller, the tickler impeller comprising at least three curved tickler impeller blades mounted for rotation on the shaft, the curved blades extending upwardly at an angle from the horizontal of from 15° to less than 90°, the blades of the impeller having a length which is longer than the length of the blades of the tickler impeller, the tickler impeller blades having a concave face which faces downwardly and a convex face which faces upwardly, the concave face leading and convex face trailing when the shaft is rotated, in the direction of intended rotation of the tickler impeller, the concave face curvingly facing downward from the end of the tickler blade toward the shaft to the end of the blade tickler blade apposite the shaft, the angle from the horizontal, the downward angle of the concave face effective for creating an inward swirl towards a bottom of the container when the tickler impeller is rotated such that the concave face leads and the convex face trails.

19. The mixing impeller system of claim 18, wherein the curved blades of the tickler impeller have tips opposite the shaft which are rounded, the blades extending at an angle from the horizontal of from 15° to 75°, the concave face of the tickler blades having an average angle from the vertical of about 30° to about 60°.

20. The mixing impeller system of claim 19, wherein the curved tickler blades have an average pitch of about 45°.

21. The mixing impeller system of claim 18, wherein the tickler impeller has two to twelve curved tickler blades and the curved blades are spaced an equal distance apart from each other.

22. The mixing impeller system of claim 21, wherein the tickler blades extend upward at an angle of about 15° from horizontal.

23. The mixing impeller system of claim 19, wherein the tickler blades have rounded edges.

24. The mixing impeller system of claim 19, wherein the blade height to length has a ratio of from 0.05 to 0.75°.

25. A mixing impeller system comprising:

at least one impeller;

at least one tickler impeller; and a vertical shalt, the at least one impeller and one tickler impeller mounted on the vertical shaft, the tickler impeller mounted below the at least one impeller, the impeller and tickler impeller each comprising at least three curved blades mounted on the shaft, the blades of the impeller being longer than the tickler impeller, the curved tickler impeller blades having tips opposite the shaft which are rounded, the impeller blades extending upwardly at an angle from the horizontal of from 0° to 75°, the tickler blades having a concave face which faces downwardly at an average pitch angle from the vertical of about 30° to about 60°, the concave faces of the tickler blades curving from the shaft so that the concave faces are facing down when facing in the direction of rotation of the tickler impeller, the angle, the pitch angle being effective for creating an inward swirl towards a bottom of the container when the tickler impeller is rotated such that the concave face leads.

26. The mixing impeller system of claim 25, wherein the curved tickler blades have an average pitch of about 45°.

27. The mixing impeller system of claim 25, wherein the tickler impeller has two to twelve curved tickler blades and the curved blades are spaced an equal distance apart from each other.

28. The mixing impeller system of claim 27, wherein the tickler blades extend upward at an angle of about 15° from horizontal.

29. The mixing impeller system of claim 27, wherein the tickler blades have rounded edges.

30. The mixing impeller system of claim 27, wherein the blade height to length has a ratio of from 0.05 to 0.75°.

31. A method for draining a tank, the method comprising:

rotating a tickler impeller in the tank, the tickler impeller comprising at least two curved tickler blades mounted on a vertical shaft for rotation in the tank, the tickler being mounted below a mixing impeller having at least two blades and which impeller is also mounted on the vertical shaft, the blades of the impeller being longer than the blades of the tickler, the curved tickler blades extending upwardly at an angle from the horizontal of from 0° to less than 90°, the tickler blades having a concave face which faces downwardly towards the bottom of the tank, the concave face leading when the shaft is rotated in the direction of rotation of the tickler impeller, the concave face curvingly facing downward from the end toward the shaft to the end of the tickler blade opposite the shaft, the angle from the horizontal; and creating an inward swirl towards a bottom of the tank when the tickler impeller is rotated.

32. The method of claim 31, wherein the curved tickler blades of the tickler impeller have tips opposite the shaft which are rounded, the tickler blades extending at an angle from the horizontal of from 15° to 75°, the tickler blades having an average pitch of about 30° to about 60°.

33. The method of claim 31, wherein the curved tickler blades of the tickler impeller have tips opposite die shaft which are rounded, the tickler blades extending at an angle from the horizontal of from 0° to 75°, the blades having an average pitch of about 30° to about 60°.

34. The method of claim 31, wherein the curved tickler blades have an average pitch of about 45°.

35. The method of claim 31, wherein the tickler impeller has two to twelve curved tickler blades and the curved tickler blades are spaced an equal distance apart from each other.

36. The method of claim 31, wherein the tickler blades extend upward at an angle of about 15° from horizontal.

37. The method of claim 31, wherein the tickler blades have rounded edges.

38. The method of claim 31, wherein the tickler blade height to length has a ratio of from 0.05 to 0.75°.

39. An apparatus in a container comprising:

a container, the container having a conically-shaped bottom and a bottom drain; and a tickler impeller in the container above the conical bottom of the container, the tickler impeller having at least two curved blades mounted on a vertical shalt for rotation in a container, the curved blades extending upwardly at an angle from the horizontal of from 15° to less than 90°, each of the blades having a concave face which faces downwardly towards the bottom of the container and a convex face opposite the concave face which convex face faces upwardly, the concave face leading and convex face trailing when the tickler impeller is rotated in the direction of rotation of the tickler impeller, the concave face curvingly facing downward from the end toward the shaft to the end of the blade opposite the shaft, the angle from the horizontal and the downward angle of the face being effective for creating an inward swirl towards the bottom of the container when the tickler impeller is rotated in the direction such that the concave face leads and the convex face trails, and the angle from the horizontal, the downward angle of the face and the curvature of the tickler impeller are effective for decreasing drain time of the container as compared to a downward pumping pitch blade turbine having the same number of blades, blades of the same size and blades of the same pitch.

40. The apparatus of claim 39 wherein the shaft includes a hub, the curved blades having tips opposite the hub which are rounded, the blades extending at an angle from the horizontal of from 15° to 75°, the blades having an avenge pitch of about 30° to about 60°.

41. The apparatus of claim 40, wherein the curved blades have an average pitch of about 45°.

42. The apparatus of claim 40, wherein the tickler impeller has three to twelve curved blades and the curved blades are spaced an equal distance apart from each other.

43. The apparatus of claim 40, wherein the curved blades have lowest edges and a line tangent to such lowest edges extending at an angle which is at least parallel to the bottom of the tank.

44. The apparatus of claim 40, wherein the blades extend upward at an angle of about 15° from horizontal.

45. The apparatus of claim 40, wherein the blades have rounded edges.

46. The apparatus of claim 40, wherein the blade height to impeller diameter has a ratio of from 0.05 to 0.75°.

* * * * *